US011614766B2

(12) United States Patent
Michael

(10) Patent No.: US 11,614,766 B2
(45) Date of Patent: Mar. 28, 2023

(54) MACHINE JOYSTICK WITH COMFORT AND ACCESSIBILITY FEATURES

(71) Applicant: CATERPILLAR INC., Peoria, IL (US)

(72) Inventor: Harry Xavier Michael, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 275 days.

(21) Appl. No.: 16/844,298

(22) Filed: Apr. 9, 2020

(65) Prior Publication Data

US 2021/0318712 A1 Oct. 14, 2021

(51) Int. Cl.
*G05G 9/047* (2006.01)
*E02F 9/20* (2006.01)

(52) U.S. Cl.
CPC ..... *G05G 9/047* (2013.01); *E02F 9/2004* (2013.01); *G05G 2009/04774* (2013.01)

(58) Field of Classification Search
CPC ..... G05G 9/047; G05G 2009/04774; E02F 9/2004; E02F 9/205
See application file for complete search history.

(56) References Cited

U.S. PATENT DOCUMENTS 4,216,467 A * 8/1980 Colston ..... G01L 5/164 414/6
5,042,314 A 8/1991 Rytter et al.
6,148,593 A 11/2000 Heinsey et al.
6,509,839 B2 1/2003 Nagatuska
7,497,298 B2 3/2009 Shearer et al.
7,775,317 B1 * 8/2010 Goodwin ..... B60K 26/02 180/323
8,212,770 B2 7/2012 Obourn et al.
10,815,643 B2 * 10/2020 Wuisan ..... G05G 1/06
2003/0038781 A1 * 2/2003 Hsu ..... G05G 9/04788 345/161
2009/0149709 A1 6/2009 Koitabashi
2009/0201250 A1 * 8/2009 Vazquez ..... G05G 9/047 345/161
2011/0088961 A1 * 4/2011 Case ..... B62D 1/12 180/335

(Continued)

FOREIGN PATENT DOCUMENTS

EP 3115863 B1 8/2019

*Primary Examiner* — Darlene P Condra
(74) *Attorney, Agent, or Firm* — Finnegan, Henderson, Farabow, Garrett & Dunner, LLP.

(57) ABSTRACT

A joystick for performing control functions of a machine having a work tool may include a base portion configured to at least partially support an operator's hand, and a handle extending from the base portion. The base portion may be configured for connection to a control interface surface in a machine cabin or on a remote control console or a remote operator's station for the machine. The handle may extend from the base portion with a proximal end of the handle being connected to the base portion, and a distal end of the handle supporting a head portion of the joystick. The head portion of the joystick may include a back surface that is contiguous with a back surface of the handle, and a front surface including a face plate tilted at an angle of 10 degrees plus or minus 5 degrees in a direction toward a position of the operator sitting in an operator's seat of the machine with respect to a plane parallel to the back surface.

20 Claims, 5 Drawing Sheets

(56) References Cited

U.S. PATENT DOCUMENTS

| | | | | |
|---|---|---|---|---|
| 2013/0133469 | A1* | 5/2013 | Rey | G05G 1/58 74/558.5 |
| 2013/0147611 | A1* | 6/2013 | Brendel | G08C 17/02 340/12.5 |
| 2013/0306395 | A1* | 11/2013 | Frazier | G05G 5/03 180/333 |
| 2016/0145828 | A1* | 5/2016 | French | E02F 3/844 74/543 |
| 2018/0002893 | A1* | 1/2018 | Heinzmann | E02F 9/2012 |
| 2018/0058039 | A1* | 3/2018 | Fredrickson | G05G 5/05 |
| 2018/0067513 | A1* | 3/2018 | Kure | E02F 9/2004 |
| 2018/0120888 | A1* | 5/2018 | Meuzelaar | A63F 13/2145 |
| 2018/0253158 | A1* | 9/2018 | Chen | G06F 3/0383 |
| 2018/0341340 | A1* | 11/2018 | Larkin | G06F 1/169 |
| 2019/0042003 | A1* | 2/2019 | Parazynski | E02F 9/2012 |
| 2019/0359257 | A1* | 11/2019 | Johnson | E02F 9/2012 |
| 2020/0111635 | A1* | 4/2020 | Paquette | G05G 1/01 |
| 2020/0137957 | A1* | 5/2020 | Friesen | B65G 53/66 |
| 2020/0387238 | A1* | 12/2020 | Parazynski | G08B 5/36 |

* cited by examiner

MACHINE JOYSTICK WITH COMFORT AND ACCESSIBILITY FEATURES

TECHNICAL FIELD

The present disclosure relates generally to a joystick for a machine, and more particularly, to a machine joystick with improved comfort and accessibility features.

BACKGROUND

Some earth moving machines, for example dozers, motor graders, wheel loaders, and snow plows, have a front-mounted work tool such as a blade, bucket, or plow for pushing or carrying material. These work tools can be tilted about a first horizontal axis that is generally perpendicular to the work tool (i.e., aligned with a travel direction), pitched about a second horizontal axis that is generally parallel to the work tool, and lifted relative to a ground surface. Tilting can be accomplished by extending a hydraulic cylinder located at a first side of the work tool, while simultaneously retracting a hydraulic cylinder located at an opposing side of the work tool. Pitching can be accomplished by extending or retracting both hydraulic cylinders in the same direction at the same time. Lifting of the work tool can be accomplished through extension of a separate lift cylinder. Existing hydraulic systems utilize different combinations of input devices to regulate the tilting, pitching, and lifting operations. Primary operator inputs for mobile vehicle motion include transmission direction (forward, neutral, or reverse), transmission speed setting, steering direction and magnitude, engine speed, and application of service brakes. Because there are multiple inputs to be controlled, these inputs generally require an operator of the machine to use both hands and both feet. In some existing dozers the transmission direction, transmission speed setting, and steering direction and magnitude are combined into a left-hand joystick. With a high idle machine such as a dozer, a right food pedal is often used to decelerate the engine speed from high idle toward a fully decelerated engine speed when slowing down the travel speed of the machine. A left foot pedal is often used in conjunction with the right foot pedal, with the left foot pedal controlling the service brakes for the machine.

When a machine is being controlled, either by an operator onboard the machine, or remotely, such as by a portable console which is hand-held or supported by a body harness, or at a remote operator station, which simulates the environment within a machine cab, in some implementations there may be two joysticks, with the left joystick being used for control of transmission speed settings and steering, and the right joystick being used for control of a blade or other work tool. In some implementations with a remote control console the operator must control all functions of the machine with two hands and no foot pedals. The left joystick may have two or more control axes, with a left-right axis being used for steering direction and magnitude, and a front-back axis being used to set transmission direction. The joystick may also have a vertical axis about which it can be rotated, with rotation of the joystick about the vertical axis resulting in changes to the transmission speed settings. Conventional remote control consoles may include finger-tip-controlled paddles that are used by the operator in place of a decelerator foot pedal and a service brake foot pedal. An exemplary remote control system for a work machine is disclosed in U.S. Pat. No. 8,428,791 to Carlsson, issued on Apr. 23, 2013 (the '791 patent). Specifically, the '791 patent discloses a remote control system for a machine, with the system including at least one control stick or joystick and a number of buttons, levers, and/or knobs for operating the different travel and working functions of the machine.

Although the remote control system of the '791 patent includes joysticks and other input devices having different functions in different modes, the '791 does not disclose a control system that includes a joystick with the improved ergonomic, comfort, and accessibility features of the joystick according to this disclosure. The joystick design of the present disclosure changes the shape and configuration of the joystick used in conventional designs in very specific ways such that an operator using the joystick experiences a more comfortable and ergonomic feel with easy access to control buttons and wheels arranged on the faceplate of the joystick. The disclosed joystick configuration enables accurate positioning of the joystick, for example, using just the thumb of the left hand to move the joystick forward, or using just fingertips touching flat surfaces on the sides of the joystick to move the joystick in left and right directions, while easily accessing controls on the faceplate of the joystick without experiencing fatigue during extended periods of operating the machine using the joystick.

The joystick according to the present disclosure addresses one or more of the needs set forth above and/or other problems of the prior art.

SUMMARY

In one aspect, the present disclosure is directed to a joystick for performing control functions of a machine having a work tool. The joystick may include a base portion configured to at least partially support an operator's hand. The base portion may be configured for connection to a control interface surface in a machine cabin or on a remote control console or a remote operator's station for the machine. A handle may extend from the base portion with a proximal end of the handle being connected to the base portion, and a distal end of the handle supporting a head portion of the joystick. The head portion of the joystick may include a back surface that is contiguous with a back surface of the handle, and a front surface including a face plate tilted at an angle of 10 degrees plus or minus 5 degrees in a direction toward a position of the operator sitting in an operator's seat of the machine with respect to a plane parallel to the back surface.

In another aspect, the present disclosure is directed to an input device for performing control functions of a machine having a work tool. The input device may include a base portion configured to include an upward-facing surface shaped to form a palm support for an operator's hand. A handle may extend from the base portion, the handle including a proximal end connected to the base portion, and an opposite distal end. A head portion of the joystick is disposed at the distal end of the handle, the head portion comprising a back surface that is contiguous with a back surface of the handle, and a front surface including a face plate tilted at an angle of 10 degrees plus or minus 5 degrees in a direction toward a position of the operator sitting in an operator's seat of the machine with respect to a plane parallel to the back surface.

In yet another aspect, the present disclosure is directed to a machine having a work tool and an input device. The input device may include a base portion configured to be connected to a control interface surface on an armrest of an operator's chair in a cabin of the machine, a handle extending from the base portion with a proximal end of the handle being connected to the base portion, and a distal end of the handle supporting a head portion of the input device. The head portion of the input device may comprise a back surface lying in a first plane that intersects a back surface of the handle, and a face plate tilted at an angle of 10 degrees plus or minus 5 degrees in a direction toward a position of an operator sitting in an operator's seat of the machine with respect to the first plane. The face plate may also include one of a pair of upshift and downshift buttons or a roller configured to perform one of discrete or continuously variable shifting, respectively, of a transmission of the machine. The face plate may further include a thumb rest for a thumb of an operator's left hand, the thumb rest configured as a recess defined into the face plate from a bottom edge of the face plate as viewed by the operator sitting in the operator's seat.

DETAILED DESCRIPTION

Figure 1:
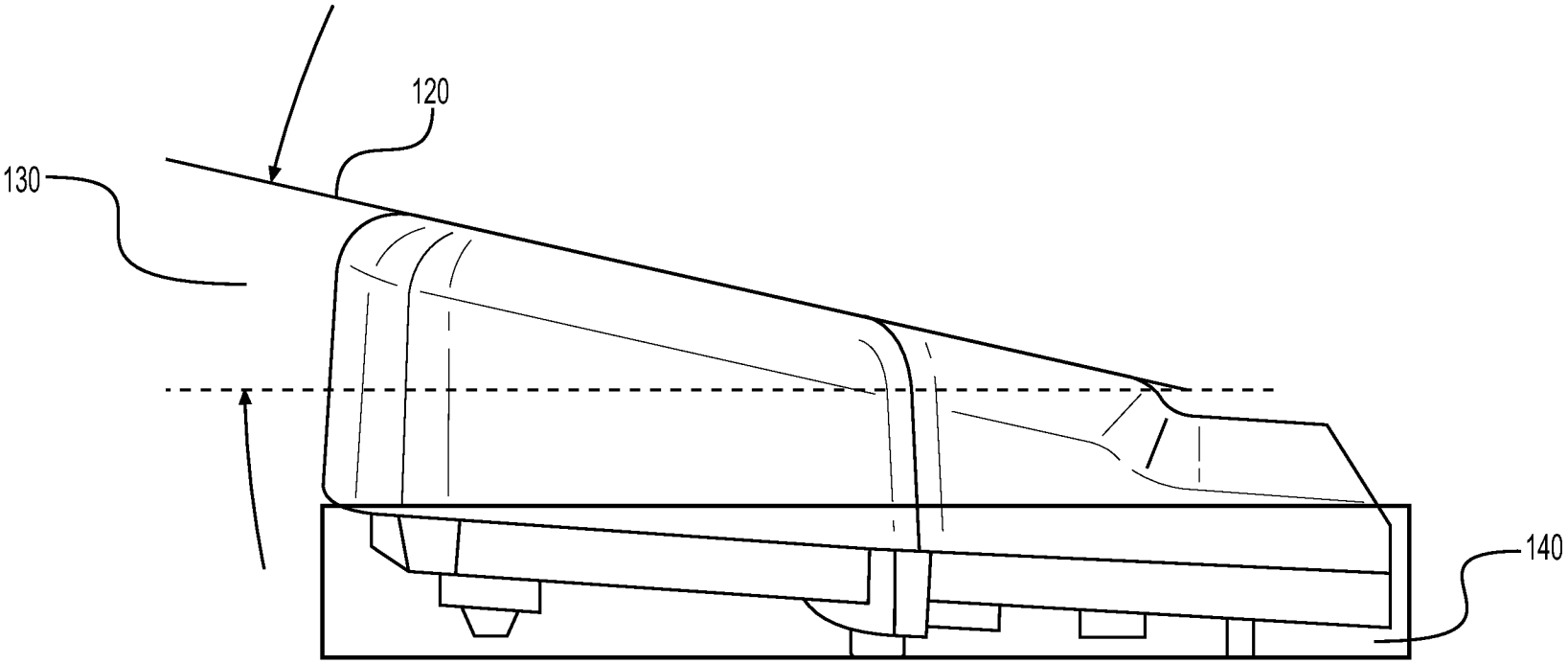
FIG. 1 is a side pictorial illustration of an exemplary disclosed head portion of a joystick according to an embodiment of this disclosure.

FIGS. 1-5 illustrate an exemplary input device in the form of a joystick 20 used in controlling various operational functions of a machine having multiple systems and components that cooperate to accomplish a task. The machine controlled by joystick 20 may embody a mobile machine that performs some type of operation associated with an industry such as mining, construction, farming, transportation, or another industry known in the art. For example, an exemplary machine may be a material moving machine such as a dozer, a motor grader, a wheel loader, a snowplow, or similar machine. The machine may include an implement system configured to move a work tool, a drive system for propelling the machine, a power source that provides power to the implement system and drive system, and an operator station that provides for control of the implement system, drive system, and/or power system.

The implement system may include a linkage structure acted on by fluid actuators or other types of actuators to move a work tool. Specifically, the implement system may include a push frame or other fixturing component, assembly, or rig that is connected to a drive system and an edge or other portion of a work tool. In some implementations, one or more hydraulic cylinders (lift cylinders) may pivotally connect the push frame to a machine frame and be functional to raise and lower the work tool relative to a ground surface. Additional hydraulic cylinders (referred to as yaw cylinders) may pivotally connect the push frame to opposing side edges of the work tool and be functional to yaw the work tool about a vertical axis. Still further linkage members and hydraulic cylinders or other actuators may connect the push frame to other portions of a work tool and be functional to roll the work tool about a horizontal axis. In the case of a motor grader, joystick 20 may include push buttons for incremental or discrete up and down shifting of a transmission of a machine between different gear ratios, or a roller for continuously variable up and down shifting of a transmission of a machine. In various alternative embodiments, depending on the type of machine being controlled by joystick 20, additional aspects of joystick 20 may include push buttons for controlling the amount of wheel lean on the machine, still further buttons located, for example, on a side of the joystick for providing grade control and possibly control of a snow wing, one or more toggle switches or rocker switches with multiple activation directions that can be activated in each of the directions to control different functional aspects of the machine, the ability to rotate the entire joystick about a vertical axis through a handle of the joystick for controlling articulation of a motor grader front and rear portions, and controlling rotational movement of a circle assembly and drawbar and moldboard of a motor grader, and the ability to move the joystick frontward and backward to control lifting and lowering of a work tool of the machine.

In some exemplary embodiments of a machine including joystick 20, the machine may include an arm configured to extend vertically upward away from a center of a push frame toward an upper edge of a work tool, and a hydraulic cylinder (pitch cylinder) may pivotally connect a distal tip of the arm to the upper edge. The pitch cylinder may be functional to pitch the work tool of the machine about a horizontal axis that is generally perpendicular to an axis aligned or parallel with a travel direction of the machine. An additional hydraulic cylinder (roll cylinder) may extend from the distal tip of the arm to a point on the work tool located between the arm and a side edge of the work tool. The roll cylinder may be functional to roll the work tool about a horizontal axis. The horizontal axis may be generally aligned with or parallel to the travel direction of the machine.

Numerous different work tools may be attachable to a single machine and operator controllable. A work tool may include any device used to perform a particular task such as, for example, a blade, a bucket, a plow, or another task-performing device known in the art. The work tool could additionally slide, swing, open and close, or move in another manner known in the art.

A drive system of the machine may include various configurations including opposing undercarriage assemblies, each having a sprocket driven by a power source to rotate a corresponding endless track. Each undercarriage assembly may also include a base member operatively connected to the sprocket and/or push frame to support the ends of the push frame. It is contemplated that the drive system could alternatively include traction devices other than tracks, if desired, such as wheels, belts, or other known traction devices.

A power source for the machine may embody an engine such as, for example, a diesel engine, a gasoline engine, a gaseous fuel-powered engine, or any other type of combustion engine known in the art. It is contemplated that the power source may alternatively embody a non-combustion source of power such as a fuel cell, a power storage device, or another known source. The power source may produce a mechanical or electrical power output that is used to propel the machine via a drive system and that can be converted to hydraulic power for moving various hydraulic cylinders that actuate different members of the machine supporting the work tool, and the work tool itself.

An operator station or remote control console may include input devices that receive input from a machine operator indicative of desired machine maneuvering. Specifically, an operator station may include one or more input devices such as joystick 20 located proximate an operator's seat. The input devices such as joystick 20 may be manipulated by an operator to control movement of a machine, one or more articulable members of the machine, or a work tool of the machine by producing proportional displacement signals that are indicative of desired maneuvering. In the disclosed embodiment, joystick 20 may be associated with control of lifting, pitching, rolling, and yawing movements of a work tool, and/or changing direction and speed of a transmission of the machine, changing a travel speed of the machine, and/or steering the machine. It is contemplated that joystick 20 may be a left-hand joystick positioned on a left-hand arm rest of an operator's seat on the machine.

Figure 3:
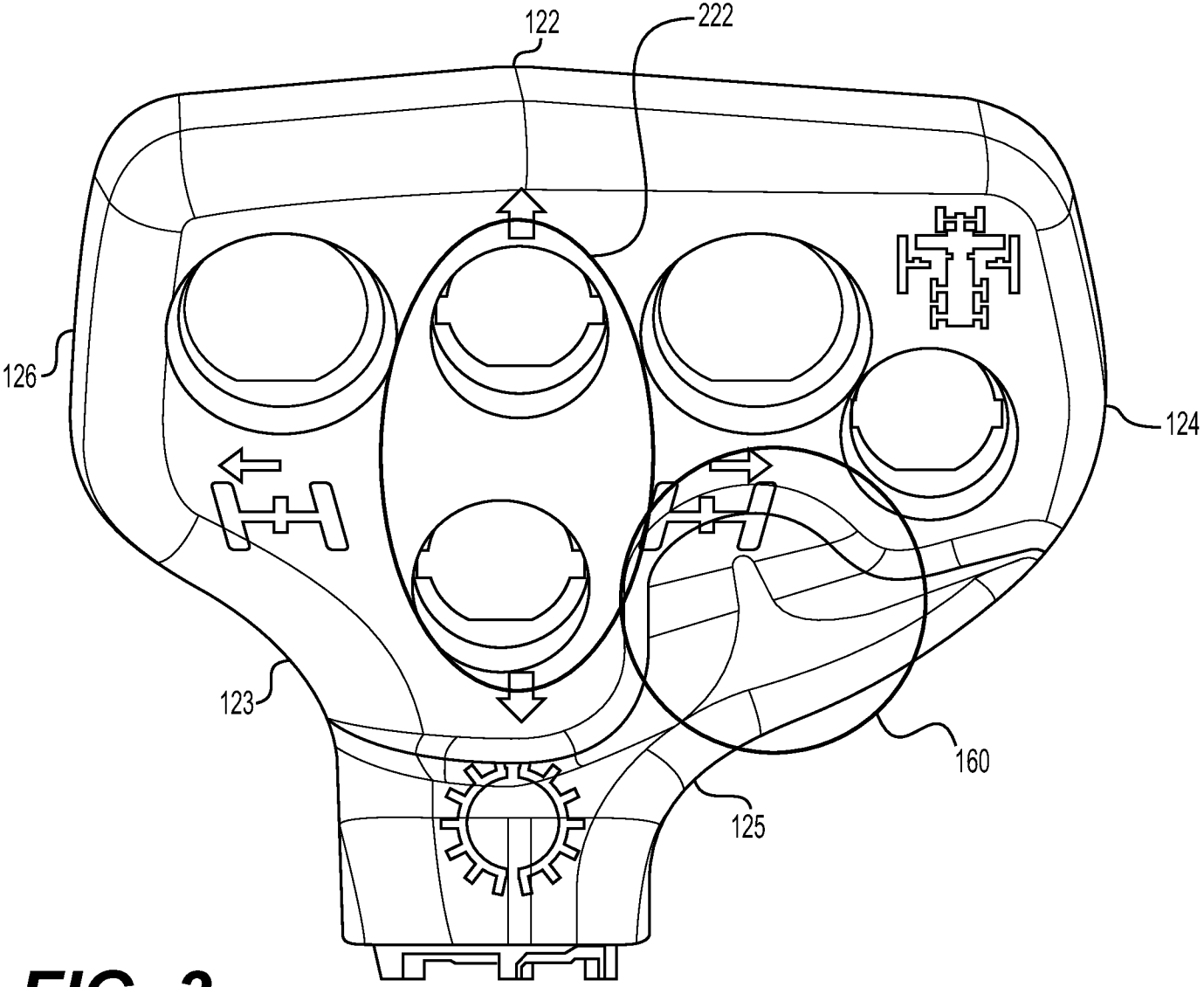
FIG. 3 is a front pictorial illustration of a second embodiment of the exemplary disclosed head portion of the joystick shown in FIG. 1.
Figure 4:
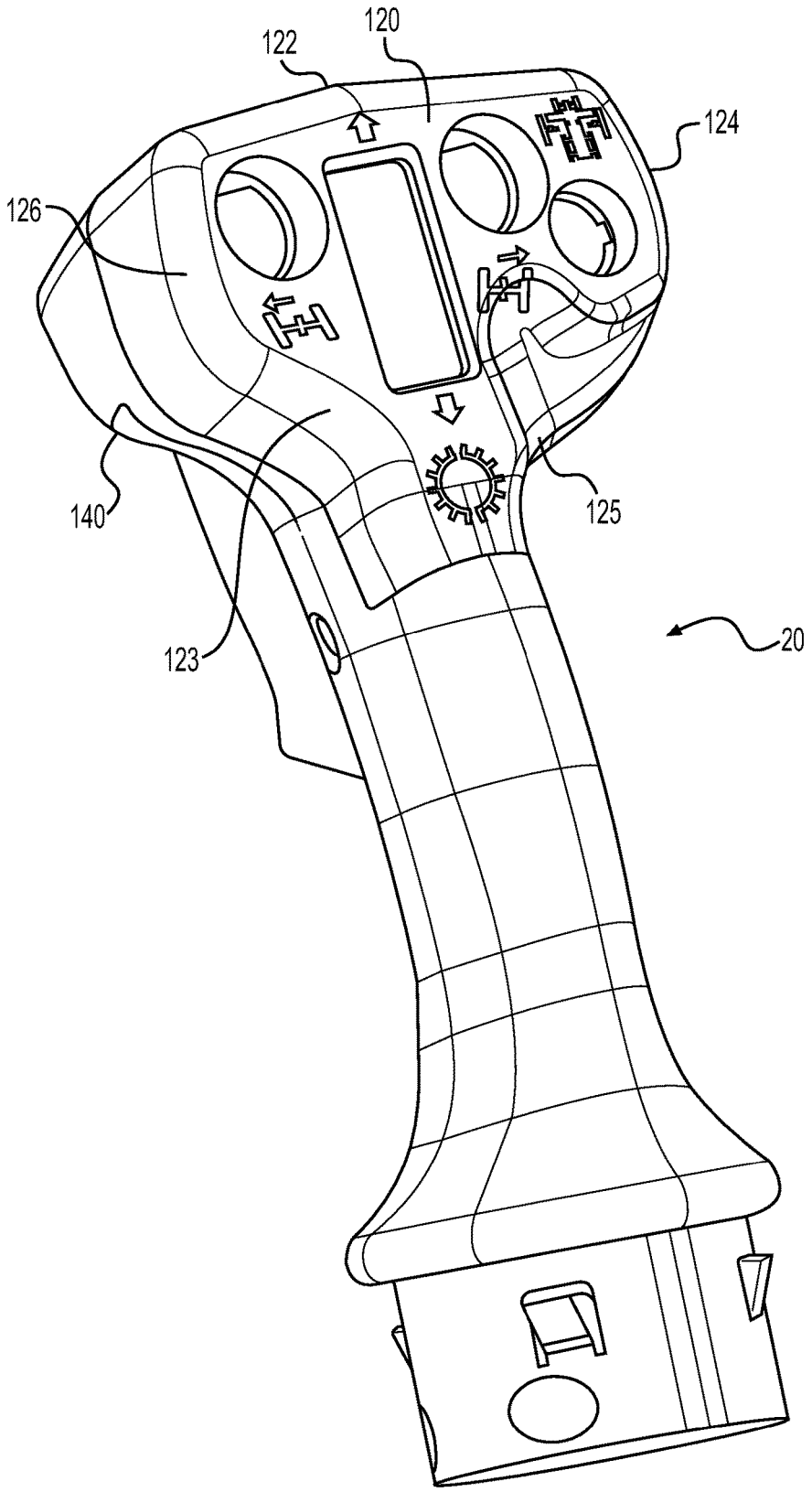
FIG. 4 is a perspective view of a joystick including the exemplary head portion shown in FIG. 2.
Figure 5:
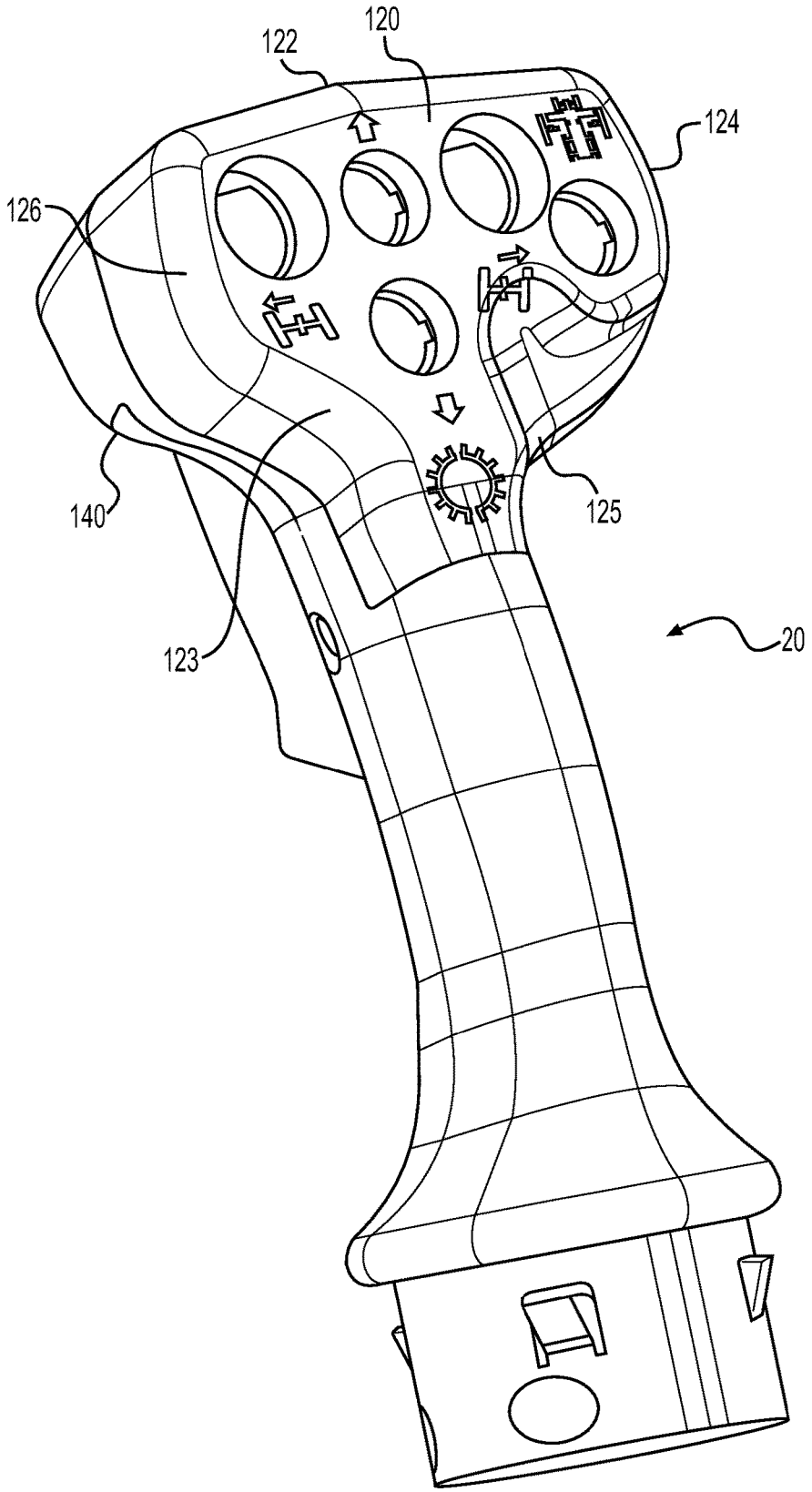
FIG. 5 is a perspective view of a joystick including the exemplary head portion shown in FIG. 3.

FIG. 1 illustrates a side elevation view of a head portion of joystick 20, shown in perspective in the alternative embodiments illustrated in FIGS. 4 and 5. Joystick 20 may include a base portion configured to be connected to a control interface surface in a cabin or at an operator's station of the machine, for example, to an arm rest of an operator's chair. A handle of joystick 20 may extend from the base portion with a proximal end of the handle being connected to the base portion, and a distal end of the handle supporting a head portion of the joystick. The head portion of the joystick may comprise a back surface 140 that is contiguous with a back surface of the handle, and a face plate 120 tilted at an angle 130 of at least 10 degrees in a direction toward a position of an operator sitting in an operator's seat of the machine with respect to a plane parallel to back surface 140. In various exemplary embodiments of joystick 20, faceplate 120 may be configured to lie in a plane that is tilted at angle 130 of 10 degrees plus or minus 5 degrees in a direction toward a position of an operator sitting in an operator's seat of the machine with respect to a plane parallel to back surface 140. Face plate 120 may also include one of a pair of upshift and downshift buttons 222, shown in the embodiment of FIG. 3, or a roller 220, shown in the embodiment of FIG. 2. Upshift and downshift buttons 222 may be configured to perform discrete shifting between different gear ratios of a transmission of a machine. Alternatively, roller 220 may be configured to perform continuously variable shifting of a transmission of the machine. In some exemplary embodiments of joystick 20, face plate 120 may further include a thumb rest 160 for a thumb of an operator's left hand. The thumb rest 160 may be configured as a recess defined into face plate 120 from a bottom edge 125 of face plate 120 extending rightward from the handle of joystick 20 as viewed by the operator sitting in the operator's seat. Rightward-extending bottom edge 125 may be configured with a partially concave contour that is contiguous with a convex contour extending around a right edge 124 of the head portion of joystick 20.

Figure 2:
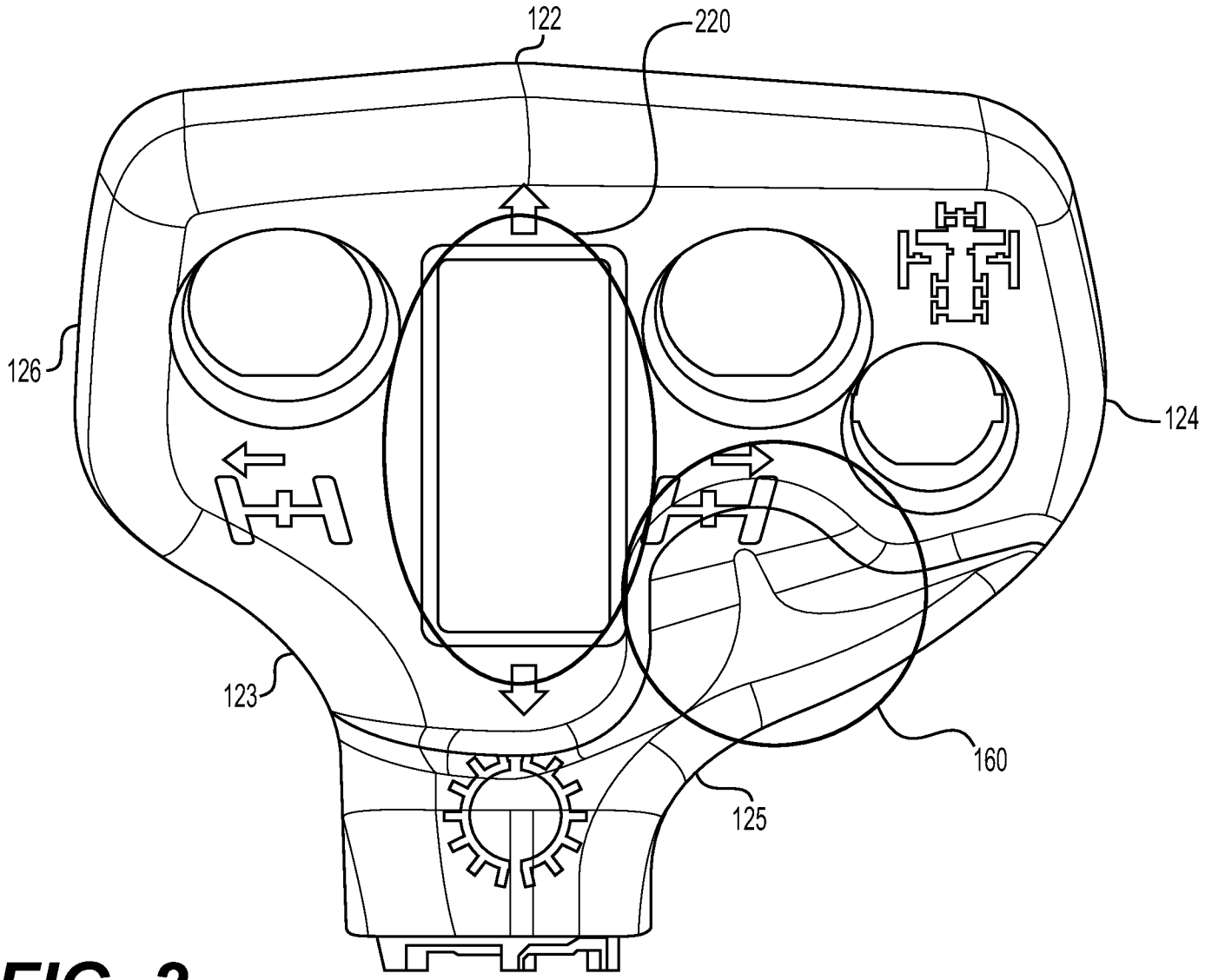
FIG. 2 is a front pictorial illustration of a first embodiment of the exemplary disclosed head portion of the joystick shown in FIG. 1.

The exemplary embodiment of joystick 20 shown in FIG. 4 may include a head portion with faceplate 120 configured as shown in FIG. 2. In addition to the roller 220 configured for continuously variable shifting of a transmission of a machine, a bottom edge 123 extending leftward from the handle of joystick 20 as viewed by an operator of the machine may include a concave curvature extending upward from the handle, with leftward-extending bottom edge 123 being shorter than rightward-extending bottom edge 125. The concave curvature of leftward-extending bottom edge 123 may be contiguous with a convex contour extending around a left edge 126 of the head portion of joystick 20. The exemplary embodiment of joystick 20 shown in FIG. 5 may include a head portion with faceplate 120 configured as shown in FIG. 3. In addition to the upshift and downshift buttons 222 configured for incremental or discrete shifting between specific gear ratios of a transmission of a machine, a bottom edge 123 extending leftward from the handle of joystick 20 as viewed by an operator of the machine may include a concave curvature extending upward from the handle, with leftward-extending bottom edge 123 being shorter than rightward-extending bottom edge 125. The concave curvature of leftward-extending bottom edge 123 may be contiguous with a convex contour extending around a left edge 126 of the head portion of joystick 20.

In one embodiment, the proximal end of joystick 20 is connected to an armrest of an operator's seat, such that the operators arm may be supported by the armrest with the left hand of the operator resting at least partially on a lower flared portion of the handle. The exemplary configurations of joystick 20 shown in FIGS. 1-5 may be intended for use by the left hand of the operator. Alternative embodiments may include variations to the illustrated configuration, while still maintaining a face plate tilted at an angle of at least 10 degrees, or 10 degrees plus or minus 5 degrees in a direction toward a position of an operator sitting in an operator's seat of the machine with respect to a plane parallel to a back surface of the head of the joystick, and a recess forming the thumb rest 160 at a lower edge of the face plate configured for accommodating the thumb of an operator's right hand.

The position of thumb rest 160 extending upward from rightward-extending bottom edge 125 of the head of joystick 20 enables an operator to easily rest the thumb of their left hand in the recess and perform delicate maneuvering of joystick 20 using just their thumb in situations when only small movements are needed. Extensive experimenting with different positions and orientations of the faceplate 120 on the head of joystick 20 resulted in a determination that most operators preferred faceplate 120 to be angled at 10 degrees plus or minus 5 degrees in a direction toward a position of an operator sitting in an operator's seat of the machine with respect to a plane parallel to a back surface of the head of the joystick. This configuration enables the operator to easily reach the various control buttons and/or wheels on faceplate 120 without experiencing fatigue when operating a machine for extended periods of time.

In various alternative embodiments of joystick 20, faceplate 120 may be configurable in order to allow joystick 20 to be changed and utilized on a variety of different machines. In different configurations of joystick 20, faceplate 120 may be a molded plastic member with openings for different buttons, rollers, and switches that are different in number, size, and position, depending on the machine that will be operated by joystick 20, and the control functions that will be performed.

The specific shape of the handle of joystick 20 around the outside of the portion of the handle that will be gripped by an operator, and toward the front side of the handle is configured to achieve a number of different purposes. The outside peripheral surface of the gripping portion of the handle may be configured with a slight curvature to provide improved comfort across a wide range of hand sizes and palm shapes. The side surfaces of the gripping portion are configured with geometries that blend into the front surface of the joystick and define the gripping portion that allows an operator to twist joystick 20 with a minimal amount of effort. The front surface of joystick 20 may also be configured to blend into the flared base portion of the handle in a configuration designed to match the natural curvature of a human hand, and relieve a potential pressure point on the palm and little finger of an operator's hand.

The outside of the joystick base may also change shape toward the rear of the joystick to allow space for the bulge on the outside of a hand when gripping the handle. In preferred configurations, the outer peripheral surface of the base of joystick 20 and the transition from the base to the handle may be provided with a clearance to remove any potential pressure point and improve comfort.

Recessed thumb rest 160 may be designed to follow the curvature of the hand and thumb when in the natural resting position, thereby reducing fatigue that may otherwise result over extended periods of time when an operator is pressing on joystick 20 using only the thumb for more delicate maneuvers. The recessed thumb rest area also allows space and positioning for quick access to thumb activated switches that may be included on the faceplate of joystick 20. Additionally, through extensive testing with a large number of different machine operators, it has been discovered that the illustrated configuration of recessed thumb rest 160 improves controllability and reduces stress in the operator's hand when gripping joystick 20 and twisting the joystick for various functions such as changing transmission speed settings. Recessed thumb rest 160 also allows for placement of an operator's thumb in a manner when pushing the joystick forward using the thumb that increases the lever action and reduces the amount of force that an operator needs to apply to move the joystick, thus reducing fatigue. Recessed thumb rest 160 provides a key feature for enabling small and precise movement of joystick 20 by allowing an operator to use only their thumb when moving the joystick. The configuration of faceplate 120 in the vicinity of thumb rest 160 also enables faster and easier movement of the thumb from the grip position to activation of buttons or switches on faceplate 120. The smooth concave and convex curvatures along rightward-extending bottom edge 125 and along leftward-extending bottom edge 123 also remove any obstacles or obstructions that would be present if the head of joystick 20 were configured with square corners. Additionally, at least the gripping portion of the handle of joystick 20 may include embossed patterns, such as hexagonal-shaped chamfers, and other features imprinted into the outer peripheral surface of the handle for styling considerations as well as to improve grip and assist with ventilation and the transference of moisture away from the palm of an operator's hand.

The handle of joystick 20 may pivot in at least two directions that are generally orthogonal to each other. In particular, the handle may pivot fore-and-aft about a first horizontal axis and pivot left-and-right about a second horizontal axis. In the disclosed embodiment, the fore/aft pivoting of the handle of joystick 20 may be generally aligned with a travel direction of the machine being operated by joystick 20, and in some embodiments the handle may be normally oriented at an oblique angle relative to the pivoting directions. When the handle is pivoted about a first axis, a first proportional signal may be generated indicative of desired changes to the speed of a transmission, or alternatively, lifting of a work tool by lift cylinders. When the handle of joystick 20 is pivoted about a second axis different from the first axis, a second proportional signal may be generated indicative of desired changes to a machine steering direction, or alternatively, rolling of the work tool by a roll cylinder. In some embodiments, the handle may be simultaneously pivoted about both of the axes to thereby generate a composite signal indicative a desire to simultaneously change transmission speed and change machine travel direction, or simultaneously lift and roll a work tool. The handle of joystick 20 may also be spring-centered (i.e., biased to a neutral position) relative to one or both of the axes about which it can be moved.

One or more additional control devices may be located at a distal end of the handle on the head of joystick 20 and associated with movement of a work tool. Additionally, a top surface 122 may be configured with a flat profile to allow an operator to rest their hand on that location and perform machine operations. In various embodiments of joystick 20 top surface 122 may be configured as a wide surface with smooth contours such that it provides a comfortable resting place for an operator's hand. Flat surfaces may also be provided on opposing sides of joystick 20 to allow an operator to grip the control with fingertips for small, precise left-right movements, without having to grip the entire handle of joystick 20. Additional controls on faceplate 120 may include a rocker button located gravitationally lower than momentary control elements, while momentary control elements may be linear push buttons arranged in different configurations on faceplate 120. It is contemplated that additional and/or different types of control elements may be included on faceplate 120, if desired.

Proportional control elements, such as a rocker button, may pivot in at least two directions. When a proportional control element is pivoted about an axis, a proportional signal may be generated indicative of desired operations such as pitching, yawing, or other movements of a work tool by a hydraulic cylinder. Simultaneous movement of the rocket button in two different directions may produce a composite signal indicative of a desire to simultaneously pitch and yaw a work tool. Each rocker button may be spring-centered (i.e., biased to a neutral position) relative to one or both of the axes about which it may be pivoted.

Momentary control elements may also be provided on faceplate 120 of joystick 20, and may be associated with any known function(s) of the machine and work tool that require operator input. In some implementations, momentary control elements may be associated with work tool movement. For example, one momentary control element could be associated with a tool shake function. In this example, when this particular element is depressed, any one or more cylinders connected to the work tool may be rapidly extended and retracted by a desired amount to cause shaking of the work tool. This function may be selectively activated to shake off any material stuck to the work tool. In one embodiment, the shaking of the work tool may continue as long as a corresponding control element is depressed by the operator. In another embodiment, depressing the control element once may initiate shaking, and depressing the control element a second time may terminate shaking.

In one exemplary embodiment, for example, with joystick 20 on a motor grader, one or more of control elements located on faceplate 120 of joystick 20 could be associated with a tracked grading operation. In particular, the movements of the work tool such as a circle assembly and moldboard of a motor grader may be automatically tracked and controlled based on a desired contour of a ground surface. Specifically, the work tool could be automatically lifted, pitched, rolled, and/or yawed such that an actual contour of the ground surface substantially matches a desired virtual contour. In this example, the automated tracking and moving of the work tool may be initiated, adjusted, and/or terminated using one or more of the control elements included on faceplate 120. It is contemplated that these control elements could be used for other or additional purposes, if desired.

The machine that includes joystick 20 may include a hydraulic system having a plurality of fluid components that cooperate to cause the extending and retracting movements of hydraulic cylinders used to control movement of a work tool or other components of the machine. Specifically, a hydraulic system may include a tank holding a supply of fluid, and a pump configured to pressurize the fluid and selectively direct the pressurized fluid to each of a plurality of hydraulic cylinders. The pump may be connected to the tank via a tank passage, and to each of the hydraulic cylinders via a common supply passage and separate head- and rod-end passages. The tank may be connected to each of the hydraulic cylinders via a common drain passage and head- and rod-end passages. The hydraulic system may also include a plurality of valves located between the hydraulic cylinders and the tank and pump to regulate flows of fluid through the passages.

The valves of the hydraulic system may be disposed within a common or separate valve blocks (not shown) and include, for example, a first valve associated with lift cylinders, and a second valve associated with yaw cylinders, a third valve associated with a pitch cylinder, and a fourth valve associated with a roll cylinder. Each of the valves may be disposed between the head- and rod-end passages of the corresponding cylinder(s) and common supply and drain passages, and take any configuration known in the art (e.g., pilot operated, electro-hydraulic, and/or solenoid operated configurations). Regardless of the configuration of the valves, an element associated with each valve may be movable between a first position at which a main flow of pressurized fluid from a common supply passage is allowed to pass to a head-end pressure chamber of its associated hydraulic cylinder(s) and waste fluid from a rod-end pressure chamber is allowed to pass to a common drain passage, and a second position at which the main flow of pressurized fluid from the common supply passage is allowed to pass to a rod-end pressure chamber and waste fluid from the head-end pressure chamber is allowed to pass to the common drain passage. In some embodiments, the valve element may also be moveable to a third position, at which fluid flow between the different passages is inhibited. In these embodiments, the valve element may be spring-biased toward the third position and urged to any position between the third and first or third and second positions based on a command signal. It is contemplated that additional components may be associated with the valves and/or hydraulic system, if desired, such as pressure compensating valves, check valves, pressure relief valves, pressure regulating valves, load sensing valves, resolvers, etc.

A controller may be in communication with the different components of the hydraulic system and configured to generate the valve command signals discussed above in response to operator input received via joystick 20. For example, based on the signals generated by joystick 20 during pivoting or twisting of the handle of joystick 20 and manipulation of control elements mounted on faceplate 120 at the head portion of joystick 20, the controller may be configured to selectively activate different combinations of valves to efficiently carry out operator commands.

The controller may include a memory, a secondary storage device, a clock, and one or more processors that cooperate to accomplish a task consistent with the present disclosure. Numerous commercially available microprocessors can be configured to perform the functions of the controller. It should be appreciated that the controller configured to receive signals generated by movement of joystick 20 could readily embody a general machine controller capable of controlling numerous other functions of the machine. Various known circuits may be associated with the controller, including signal-conditioning circuitry, communication circuitry, and other appropriate circuitry. It should also be appreciated that the controller may include one or more of an application-specific integrated circuit (ASIC), a field-programmable gate array (FPGA), a computer system, and a logic circuit configured to allow the controller to function in accordance with the present disclosure.

INDUSTRIAL APPLICABILITY

The disclosed joystick 20 may be used with any machine having a work tool that is capable of movement in multiple directions. The joystick may be particularly useful when applied to a machine having a blade where independent control over lifting, pitching, rolling, and yawing is beneficial. Additionally, in other implementations using joystick 20, a remote control operator's station or console including joystick 20 may allow for control of the speeds and direction of the transmission for the machine as well as steering and travel speed of the machine without the use of foot pedals. Independent control over blade lifting, pitching, rolling, and yawing may be possible through separate regulation of independent hydraulic cylinders under the direction of a machine operator.

Each of a plurality of hydraulic cylinders may be movable by fluid pressure. In particular, fluid may be drawn from a tank, pressurized by a pump, and selectively directed to control valves configured to direct the flow of hydraulic fluid to a common supply passage. In response to an operator manipulation of an input device such as joystick 20, an associated controller may selectively generate a command that causes one or more of a number of control valves to move toward a desired position at which the main flow of pressurized fluid is directed to the appropriate one of head- and rod-end pressure chambers of one or more hydraulic cylinders. Substantially simultaneously, the same valve movement may communicate the other of head- and rod-end pressure chambers of the same hydraulic cylinder with a tank via a common drain passage, thereby creating a force differential across a piston assembly within the hydraulic cylinder that causes the piston assembly to move.

For example, if lifting of a work tool such as a blade on a motor grader is commanded by the operator through pivoting of a handle of a joystick in a rearward direction (i.e., through pulling of the handle backward toward the operator) about an axis, a corresponding signal may be generated by the input device and directed to the controller. In response to receiving this signal, the controller may generate a command directed to a control valve, causing one or more rod-end chambers of associated lift cylinders to fill with pressurized fluid and retract piston assemblies. This retraction may function to raise a push frame along with a work tool. In contrast, if lowering of a work tool is commanded by the operator through pivoting of the handle of the joystick in a forward direction (i.e., through pushing of the handle away from the operator), a corresponding signal may be generated by the input device and directed to the controller. In response to receiving this signal, the controller may generate a command directed to the control valve, causing head-end chambers of lift cylinders to fill with pressurized fluid and extend piston assemblies. This extension may function to lower the push frame along with the work tool.

It will be apparent to those skilled in the art that various modifications and variations can be made to the input device of the present disclosure without departing from the scope of the disclosure. Other embodiments will be apparent to those skilled in the art from consideration of the specification and practice of the input device disclosed herein. It is intended that the specification and examples be considered as exemplary only, with a true scope of the disclosure being indicated by the following claims and their equivalent.

What is claimed is:

1. A joystick for performing control functions of a machine having a work tool, the joystick comprising:

a base portion configured to at least partially support an operator's hand, the base portion being configured for connection to a control interface surface in a machine cabin; and a handle extending from the base portion with a proximal end of the handle being connected to the base portion, and a distal end of the handle supporting a head portion of the joystick, the head portion of the joystick comprising a back surface that is contiguous with a back surface of the handle, and a front surface including a face plate tilted at an angle of 10 degrees plus or minus 5 degrees in a direction toward a position of the operator sitting in an operator's seat of the machine with respect to a plane parallel to the back surface.

2. The joystick of claim 1, wherein the face plate comprises one of a pair of upshift and downshift buttons or a roller configured to perform one of discrete or continuously variable shifting, respectively, of a transmission of the machine.

3. The joystick of claim 1, wherein the face plate comprises a thumb rest configured for accommodating a portion of a thumb of the operator's left hand, the thumb rest being configured as a recess defined into the face plate from a bottom edge of the face plate as viewed by the operator sitting in the operator's seat.

4. The joystick of claim 3, wherein the thumb rest is configured to follow the natural curvature of the operator's left hand and thumb when the operator's left hand is in a natural resting position while gripping the handle at a gripping portion of the handle.

5. The joystick of claim 4, wherein the thumb rest is configured to enable application of a first activating pressure to be applied by the thumb of the operator's left hand in a forward direction against the joystick at a greater distance from the base portion than the gripping portion of the handle in order to generate forward movement of the joystick, wherein the first activating pressure is smaller than a second activating pressure required to move the joystick forward when applying the second activating pressure at the gripping portion of the handle.

6. The joystick of claim 1, wherein the handle is configured to pivot in a first direction from a central-biased position to generate a first signal and to pivot in a second direction from the central-biased position, with the second direction being orthogonal to the first direction to generate a second signal.

7. The joystick of claim 6, wherein the joystick is configured to generate the first signal, which is indicative of a desired amount of movement of a work tool about a first axis of rotation that is horizontal relative to a ground surface under the machine and perpendicular relative to a travel direction of the machine, and to generate the second signal, which is indicative of a desired amount of movement of the work tool about a second axis of rotation that is vertical relative to the ground surface and perpendicular relative to the first axis.

8. The joystick of claim 1, wherein the joystick is configured to be moved in forward and rearward directions from a central-biased position in order to generate signals indicative of operator commanded changes in the travel speed of the machine in forward and rearward directions, respectively.

9. The joystick of claim 1, wherein the faceplate is configured with an asymmetrical outline with a first portion of a bottom edge of the face plate extending to the right of the handle as viewed by the operator sitting in the operator's seat by a greater distance than a second portion of the bottom edge of the face plate extending to the left of the handle, and the face plate further including a thumb rest configured as a recess defined into the face plate from the first portion of the bottom edge of the face plate.

10. An input device for performing control functions of a machine having a work tool, the input device comprising:

a base portion configured to include an upward-facing surface shaped to form a palm support for an operator's hand;

a handle extending from the base portion, the handle including a proximal end connected to the base portion, and an opposite distal end; and a head portion of the input device disposed at the distal end of the handle, the head portion comprising a back surface that is contiguous with a back surface of the handle, and a front surface including a face plate tilted at an angle of 10 degrees plus or minus 5 degrees in a direction toward a position of the operator sitting in an operator's seat of the machine with respect to a plane parallel to the back surface.

11. The input device of claim 10, wherein the face plate comprises one of a pair of upshift and downshift buttons or a roller configured to perform one of discrete or continuously variable shifting, respectively, of a transmission of the machine.

12. The input device of claim 10, wherein the face plate comprises a thumb rest configured for accommodating a portion of a thumb of the operator's left hand, the thumb rest being configured as a recess defined into the face plate from a bottom edge of the face plate as viewed by the operator sitting in the operator's seat.

13. The input device of claim 12, wherein the thumb rest is configured to follow the natural curvature of the operator's left hand and thumb when the operator's left hand is in a natural resting position while gripping the handle at a gripping portion of the handle.

14. The input device of claim 13, wherein the thumb rest is configured to enable application of a first activating pressure to be applied by the thumb of the operator's left hand in a forward direction against the input device at a greater distance from the base portion than the gripping portion of the handle in order to generate forward movement of the input device, wherein the first activating pressure is smaller than a second activating pressure required to move the input device forward when applying the second activating pressure at the gripping portion of the handle.

15. The input device of claim 10, wherein the handle is configured to pivot in a first direction from a central-biased position to generate a first signal and to pivot in a second direction from the central-biased position, with the second direction being generally orthogonal to the first direction to generate a second signal.

16. The input device of claim 15, wherein the handle is configured to generate the first signal, which is indicative of a desired amount of movement of a work tool about a first axis of rotation that is horizontal relative to a ground surface under the machine and perpendicular relative to a travel direction of the machine, and to generate the second signal, which is indicative of a desired amount of movement of the work tool about a second axis of rotation that is vertical relative to the ground surface and perpendicular relative to the first axis.

17. The input device of claim 10, wherein the handle is configured to be moved in forward and rearward directions from a central-biased position in order to generate signals indicative of operator commanded changes in the travel speed of the machine in forward and rearward directions, respectively.

18. The input device of claim 10, wherein the faceplate is configured with an asymmetrical outline with a first portion of a bottom edge of the face plate extending to the right of the handle as viewed by the operator sitting in the operator's seat by a greater distance than a second portion of the bottom edge of the face plate extending to the left of the handle, and the face plate further including a thumb rest configured as a recess defined into the face plate from the first portion of the bottom edge of the face plate.

19. A machine, comprising:

an input device, wherein the input device includes:

a base portion configured to be connected to a control interface surface on an armrest of an operator's chair in a cabin of the machine;

a handle extending from the base portion, with a proximal end of the handle being connected to the base portion; and a head portion supported at a distal end of the handle, the head portion comprising a back surface lying in a first plane that intersects a back surface of the handle, and a face plate tilted at an angle of 10 degrees plus or minus 5 degrees in a direction toward a position of an operator sitting in an operator's seat of the machine with respect to the first plane.

20. The machine of claim 19, wherein the face plate comprises:

at least one of a pair of upshift and downshift buttons or a roller configured to perform one of discrete or continuously variable shifting, respectively, of a transmission of the machine; and a thumb rest for a thumb of an operator's left hand, the thumb rest being configured as a recess defined into the face plate from a bottom edge of the face plate as viewed by the operator sitting in the operator's seat.

* * * * *